US005657612A

United States Patent [19]

Renz et al.

[11] Patent Number: 5,657,612

[45] Date of Patent: Aug. 19, 1997

[54] TWO STAGE GRIPPING APPARATUS AND METHOD FOR STRAPPING MACHINE

[75] Inventors: Mark Renz, Arlington Hts.; James Haberstroh, Vernon Hills, both of Ill.

[73] Assignee: Illinois Tool Works Inc., Glenview, Ill.

[21] Appl. No.: 573,459

[22] Filed: Dec. 15, 1995

[51] Int. Cl.[6] ..... B65B 13/04

[52] U.S. Cl. ..... 53/399; 53/589; 100/32

[58] Field of Search ..... 53/399, 582, 589; 100/25, 26, 32

[56] References Cited

U.S. PATENT DOCUMENTS 4,912,908 4/1990 Sakaki ..... 53/589

5,267,508 12/1993 Yoshino ..... 53/589 X 5,513,482 5/1996 Nagashima et al. ..... 53/589 X

*Primary Examiner*—Linda Johnson

*Attorney, Agent, or Firm*—Schwartz & Weinrieb

[57] ABSTRACT

In a strapping machine, a device for applying various levels of gripping force to a leading end of a strap during various phases of a strapping cycle is disclosed. A cam having high pressure, reduced pressure, and released pressure surfaces cooperates with an end gripper to grip a strap firmly, loosely, or not at all, depending on the requirements.

20 Claims, 1 Drawing Sheet

TWO STAGE GRIPPING APPARATUS AND METHOD FOR STRAPPING MACHINE

CROSS REFERENCES TO RELATED APPLICATIONS

Strap Path Access Apparatus and Method for Strapping Machine

Strap Severing and Ejecting Apparatus and Method for Strapping Machine

Obstruction Removal Apparatus and Method for Strapping Machine Inertial Strap Tensioning Apparatus and Method for Strapping Machine

BACKGROUND OF THE INVENTION

1. Field of the Invention

The present invention relates to the gripping of a strap end before and during the tensioning phase of a strapping cycle of a strapping machine.

More particularly, the present invention relates to multiple gripping force gripping of a strap end before and during the tensioning phase of a strapping cycle of a strapping machine.

2. Description of Related Art

In the past, strapping machines were capable of exerting a single, generally high level gripping force on the leading end of a strap so as to secure the strap end during the slack removal and tensioning phase, prior to strap sealing, of the strapping machine cycle. However, the application of a high gripping force to the strap end during the rest phase of the strapping cycle, prior to the tensioning phase, increases the difficulty of pulling the strap out of the gripper if necessary, to clear a strap jam, change over the strap, or rewind the strap coil.

This and other problems of the prior art are solved by the invention disclosed herein.

OBJECTS OF THE INVENTION

It is an object of the present invention to provide an end gripping device which allows for the easy removal of a leading strap end from the gripping device.

It is another object to provide a two force end gripping device which exerts a high gripping force on a leading end of a strap for the tensioning phase of the strapping cycle, and a reduced gripping force for the rest phase of a strapping cycle, prior to the tensioning phase of the cycle.

It is a further object to provide a two force end gripping device which exerts a reduced gripping force on a leading end of a strap so as to prevent the strap from bouncing back or rebounding from a sensing lever after contacting the lever.

These and other objects of the invention are satisfied by the apparatus and method disclosed herein.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DESCRIPTION OF THE PREFERRED EMBODIMENT

Figure 1:
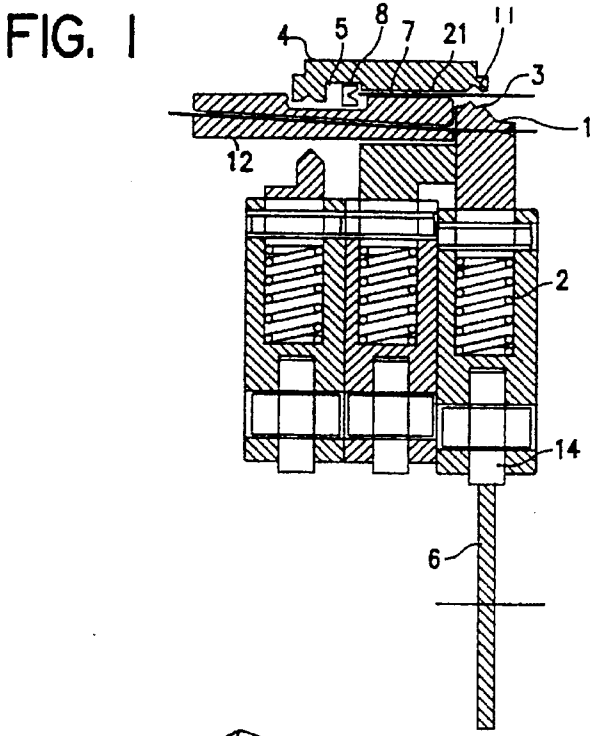
FIG. 1 is a sectional view of the present invention in the insertion phase.

Shown in FIG. 1 is the gripping apparatus in the pre-grip or insertion phase of the strapping cycle. An end gripper 1 in communication with a gripper spring 2 is driveable by a force acting on cam bearing 14. Gripper cam 6 is rotatable so as to present various cam surfaces to the cam bearing 14. A gripper tooth 3 may be disposed at a terminal end of the end gripper 1. An anvil 4 is positioned adjacent to the end gripper 1 in a manner which allows a strap leading end 7 to be inserted through a strap path 21 between the anvil 4 and the end gripper 1. The anvil 4 includes an anvil recess 5 which houses a strap limit sensing lever 8. A tooth anvil gap 11 in the anvil 4 receives the gripper tooth 3 during the gripping phase and may receive the gripper tooth 3 partially during the rest phase. The strap separator 12 adjacent the anvil 4 and the end gripper 1 receives the strap in an integral strap path in the separator 12.

Figure 2:
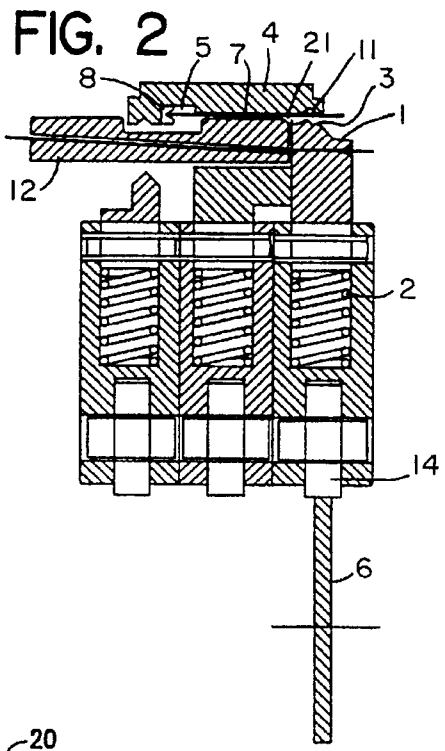
FIG. 2 is a sectional view of the present invention in the rest phase.

In FIG. 2, the end gripper 1 is shown in a low or soft grip position, where the strap leading end 7 has travelled to and tripped the limit sensing lever 8. The strapping machine is in a rest phase of the strapping cycle at this point. The gripper cam 6 has at this time been rotated to urge a particular surface of the cam 6 against the cam bearing 14, which moves the end gripper 1 against the strap 7 in a manner which holds the strap 7 in place, but would allow the removal of the strap 7 without the necessity of repositioning the end gripper 1. This gripping mode eliminates the problem of strap recoil or bounce back after contact of the strap leading end 7 with the limit sensing lever 8, by fixing the strap 7 in place immediately at the moment the leading strap end trips the limit sensing lever 8. Also, a machine operator may easily clear strap from the end gripper 1 during this phase, because of the carefully adjusted soft grip condition achieved by the device. This facilitates the procedures of strap jam clearing, strap change over, and strap coil rewinding.

Figure 3:
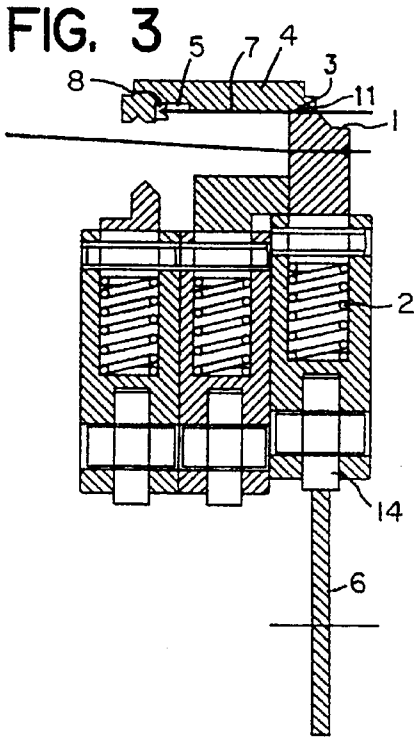
FIG. 3 is a sectional view of the present invention in the tensioning phase.

FIG. 3 shows the end gripper 1 in the tensioning phase. Gripper cam 6 has been rotated so as to urge a particular surface of the cam 6 against the cam bearing 14, which moves the end gripper 1 against the strap 7 in a manner which holds the strap 7 in a semi-permanent position. Gripper tooth 3 is urged against the strap 7, pushing a segment of the strap 7 into the tooth anvil gap 11 and against the anvil surface of the tooth anvil gap 11, firmly gripping the strap 7 in place. The strap 7 will at this phase remain gripped as the strapping machine executes the tensioning phase.

Figure 4:
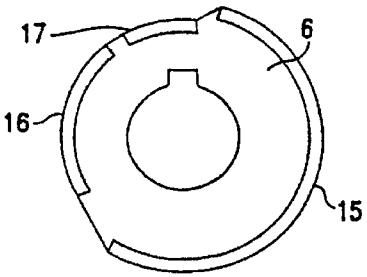
FIG. 4 is a side view of a three position cam of the present invention.

FIG. 4 shows one embodiment of the gripper cam 6. First cam surface 15 is urged against the cam bearing 14 just prior to and during the tensioning phase. Second cam surface 16 is urged against the cam bearing 14 during the strap feeding phase, and third cam surface 17 is urged against the cam beating 14 during the rest or home position phase of the strapping cycle, providing a soft grip condition.

Figure 5:
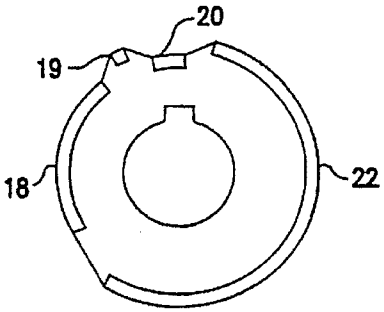
FIG. 5 is a side view of a four position cam of the present invention.

FIG. 5 shows another embodiment of the gripper cam 6. Seventh cam surface 22 is urged against the cam bearing 14 during the tensioning phase. Fourth cam surface 18 is urged against the cam bearing 14 during the strap feeding phase.

Fifth cam surface 19 is urged against the cam bearing 14 during the period at which the strap 7 must be held in a soft grip condition, for example to briefly prevent the bouncing or rebound of the strap leading 7 end. Subsequently, sixth cam surface 20 is urged against the cam bearing 14, dropping the end gripper 1 to release the grip force. Next, just before and also during the tensioning phase, seventh cam surface 22 is urged against the cam bearing 14.

The present invention also encompasses the range of equivalents to which it is entitled, and is to be limited only by the following claims.

We claim:

1. A multiple stage gripping device for use within a strapping machine for gripping a leading end portion of a strap with different degrees of force during a strapping cycle, comprising:

an anvil;

end gripper means disposed adjacent to said anvil so as to define a space therebetween within which a leading end portion of a strap is able to be disposed; and cam means having a plurality of cam surfaces for operatively engaging and biasing said end gripper means toward said anvil with different degrees of force during a strapping cycle so as to respectively cooperate with said anvil in establishing a first relatively high gripping force whereby said leading end portion of said strap is firmly secured between said end gripper means and said anvil when a first cam surface of said cam means is engaged with said end gripper means, a second reduced gripping force whereby said leading end portion of said strap is able to be retained between said end gripper means and said anvil with a relatively low-level force, but also readily removable from said space defined between said anvil and said end gripper means, when a second cam surface of said cam means is engaged with said end gripper means, and a third substantially zero gripping force whereby said leading end portion of said strap is permitted to be substantially freely inserted into and removed from said space defined between said anvil and said end gripper means when a third cam surface of said cam means is engaged with said end gripper means.

2. A multiple stage gripping device for use within a strapping machine for gripping a leading end portion of a strap with different degrees of force during a strapping cycle, comprising:

an anvil;

end gripper means disposed adjacent to said anvil so as to define a space therebetween within which a leading end portion of a strap is able to be disposed; and cam means having a plurality of cam surfaces for operatively engaging and biasing said end gripper means toward said anvil with different degrees of force during a strapping cycle so as to respectively cooperate with said anvil in establishing different gripping forces with respect to said leading end portion of said strap interposed between said anvil and said end gripper means, said plurality of cam surfaces comprising a first cam surface for engaging said end gripper means and biasing said end gripper means toward said anvil such that a first relatively high gripping force is established between said anvil and said end gripper means whereby said leading end portion of said strap is firmly secured between said end gripper means and said anvil, a second cam surface for engaging said end gripper means and biasing said end gripper means toward said anvil such that a second relatively reduced gripping force is established between said anvil and said end gripper means whereby said leading end portion is permitted to be fed into said strapping machine, a third cam surface for engaging said end gripper means and biasing said end gripper means toward said anvil such that a third relatively reduced gripping force is established between said anvil and said end gripper means whereby said leading end portion of said strap is able to be retained between said end gripper means and said anvil with a relatively low-level force, but is also readily removable from said space defined between said anvil and said end gripper means, and a fourth cam surface for engaging said end gripper means and biasing said end gripper means toward said anvil such that a fourth substantially zero gripping force is established between said anvil and said end gripper means whereby said leading end portion of said strap is permitted to be substantially freely inserted into and removed from said space defined between said anvil and said end gripper means.

3. A multiple stage gripping device for use within a strapping machine as claimed in claim 2, wherein:

said end gripper means comprises a gripper tooth; and said anvil comprises a recess for receiving said gripper tooth of said end gripper means such that when said end gripper means is engaged by said first cam surface of said cam means and biased toward said anvil, said gripper tooth of said end gripper means will engage said leading end portion of said strap and force said leading end portion of said strap into said recess of said anvil whereby said leading end portion of said strap will be firmly secured between said gripper tooth of said end gripper and an interior surface portion of said recess of said anvil.

4. A method for gripping a leading end portion of a strap within a strapping machine, with different degrees of force during a strapping cycle, comprising the steps of:

providing an anvil;

disposing an end gripper at a position adjacent to said anvil so as to define a space therebetween within which a leading end portion of a strap is able to be disposed;

providing a cam having a plurality of cam surfaces for operatively engaging and biasing said end gripper toward said anvil with different degrees of force during a strapping cycle so as to respectively cooperate with said anvil in established different gripping forces with respect to said leading end portion of said strap interposed between said anvil and said end gripper;

moving said cam such that a first cam surface of said cam engages said end gripper and biasing said end gripper toward said anvil such that a relatively low gripping force is established between said anvil and said end gripper whereby said leading end portion of said strap is loosely retained between said end gripper and said anvil but is also readily removable from said space defined between said anvil and said end gripper;

moving said cam such that a second cam surface of said cam engages said end gripper and biases said end gripper toward said anvil such that a relatively high gripping force is established between said anvil and said end gripper whereby said leading end portion of said strap is firmly secured between said end gripper and said anvil; and moving said cam such that a third cam surface of said cam engages said end gripper and biases said end gripper toward said anvil such that a substantially zero gripping force is established between said anvil and said end gripper whereby said leading end portion of said strap is permitted to be substantially freely inserted into and removed from said space defined between said anvil and said end gripper.

5. The gripping device as set forth in claim 1, further comprising:

means for moving said cam means such that said plurality of cam surfaces are alternatively presented for operative engagement with said end gripper means.

6. The gripping device as set forth in claim 1, further comprising:

means for rotating said cam means such that said plurality of cam surfaces are alternatively presented for operative engagement with said end gripper means.

7. The gripping device as set forth in claim 6, wherein:

said cam means comprises a rotatable disc.

8. The gripping device as set forth in claim 7, wherein:

said plurality of cam surfaces comprise cam surface portions defined within circumferentially spaced peripheral sections of said rotatable disc.

9. The gripping device as set forth in claim 1, wherein:

said end gripper means comprises a gripper tooth; and said anvil comprises a recess for receiving said gripper tooth of said end gripper means such that when said end gripper means is engaged by said first cam surface of said cam means and biased toward said anvil, said gripper tooth of said end gripper means will engage said leading end portion of said strap and force said leading end portion of said strip into said recess of said anvil whereby said leading end portion of said strap will be firmly secured between said gripper tooth of said end gripper means and an interior surface portion of said recess of said anvil.

10. The gripping device as set forth in claim 2, further comprising:

means for moving said cam means such that said plurality of cam surfaces are alternatively presented for operative engagement with said end gripper means.

11. The gripping device as set forth in claim 2, further comprising:

means for rotating said cam means such that said plurality of cam surfaces are alternatively presented for operative engagement with said end gripper means.

12. The gripping device as set forth in claim 11, wherein:

said cam means comprises a rotatable disc.

13. The gripping device as set forth in claim 12, wherein:

said plurality of cam surfaces comprise cam surface portions defined within circumferentially spaced peripheral sections of said rotatable disc.

14. A multiple stage gripping device for use within a strapping machine for gripping a leading end portion of a strap with different degrees of force during a strapping cycle, comprising:

an anvil;

end gripper means disposed adjacent to said anvil so as to define a space therebetween within which a leading end portion of a strap is able to be disposed; and cam means having a plurality of cam surfaces for operatively engaging and biasing said end gripper means toward said anvil with different degrees of force during a strapping cycle so as to respectively cooperate with said anvil in establishing different gripping forces with respect to said leading end portion of said strap interposed between said anvil and said end gripper means, said plurality of cam surfaces comprising a first cam surface for engaging said end gripper means and biasing said end griper means toward said anvil such that a first relatively high gripping force is established between said anvil and said end gripper means whereby said leading end portion of said strap is firmly secured between said end gripper means and said anvil, a second cam surface for engaging said end gripper means and biasing said end gripper means toward said anvil such that a second relatively reduced gripping force is established between said anvil and said end gripper means whereby said leading end portion of said strap is able to be retained between said end gripper means and said anvil with a relatively low-level force, but is also readily removable from said space defined between said anvil and said end gripper means, and a third cam surface for engaging said end gripper means and biasing said end gripper means toward said anvil such that a third substantially zero gripping force is established between said anvil and said end gripper means whereby said leading end portion of said strap is permitted to be substantially freely inserted into and removed from said space defined between said anvil and said end gripper means.

15. The gripping device as set forth in claim 14, wherein:

said end gripper means comprises a gripper tooth; and said anvil comprises a recess for receiving said gripper tooth of said end gripper means such that when said end gripper means is engaged by said first cam surface of said cam means and biased toward said anvil, said gripper tooth of said end gripper means will engage said leading end portion of said strap and force said leading end portion of said strap into said recess of said anvil whereby said leading end portion of said strap will be firmly secured between said gripper tooth of said end gripper means and an interior surface portion of said recess of said anvil.

16. The gripping device as set forth in claim 14, further comprising:

means for moving said cam means such that said plurality of cam surfaces are alternatively presented for operative engagement with said end gripper means.

17. The gripping device as set forth in claim 14, further comprising:

means for rotating said cam means such that said plurality of cam surfaces are alternatively presented for operative engagement with said end gripper means.

18. The gripping device as set forth in claim 17, wherein:

said cam means comprises a rotatable disc.

19. The gripping device as set forth in claim 18, wherein:

said plurality of cam surfaces comprise cam surface portions defined within circumferentially spaced peripheral sections of said rotatable disc.

20. The method as set forth in claim 4, further comprising the steps of:

providing said cam in the form of a rotatable disc; and providing said plurality of cam surfaces as cam surface portions defined within circumferentially spaced peripheral sections of said rotatable disc.

* * * * *